US007444089B2

(12) United States Patent
Watanabe et al.

(10) Patent No.: US 7,444,089 B2
(45) Date of Patent: Oct. 28, 2008

(54) IMAGE FORMING APPARATUS, TONER CARTRIDGE AND METHOD TO DETECT TONER LEVEL

(75) Inventors: Hiroshi Watanabe, Shizuoka-ken (JP); Masao Ando, Shizuoka-ken (JP); Hiroshi Matsumoto, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 324 days.

(21) Appl. No.: 11/365,333

(22) Filed: Feb. 28, 2006

(65) Prior Publication Data

US 2007/0201886 A1 Aug. 30, 2007

(51) Int. Cl.
*G03G 15/08* (2006.01)
*G03G 15/10* (2006.01)
*G03G 15/01* (2006.01)

(52) U.S. Cl. ..... 399/27; 399/61; 399/227

(58) Field of Classification Search ..... 399/24, 399/27, 30, 61, 62, 64, 74, 227
See application file for complete search history.

(56) References Cited

U.S. PATENT DOCUMENTS 5,532,790 A * 7/1996 Akazawa ..... 399/64
5,617,188 A * 4/1997 Inomata ..... 399/13
2004/0208660 A1 * 10/2004 Ito et al. ..... 399/27

FOREIGN PATENT DOCUMENTS

| | | | |
|---|---|---|---|
| JP | 63-34982 | | 7/1988 |
| JP | 07-225513 | | 8/1995 |
| JP | 08-123187 | | 5/1996 |
| JP | 08137175 | * | 5/1996 |
| JP | 2004-264539 | | 9/2004 |
| JP | 2004-354904 | | 12/2004 |

* cited by examiner

*Primary Examiner*—David M Gray
*Assistant Examiner*—Joseph S. Wong
(74) *Attorney, Agent, or Firm*—SoCal IP Law Group LLP; Steven C. Sereboff; John E. Gunther

(57) ABSTRACT

An image forming apparatus that forms an image according to an electrophotographic system includes plural developing units provided in a cylinder, which freely rotates a fixed angle at a time around a rotation shaft, to rotate together with the cylinder. Toner levels of toner cartridges arranged in the developing units are detected by rotating the cylinder a predetermined angle to stop the cylinder and measuring a flow-down time of a toner, which flows down inside of the toner cartridge, using an optical sensor.

7 Claims, 8 Drawing Sheets

IMAGE FORMING APPARATUS, TONER CARTRIDGE AND METHOD TO DETECT TONER LEVEL

BACKGROUND OF THE INVENTION

1. Field of the Invention

The present invention relates to an image forming apparatus such as a laser copying machine or a laser printer including a revolver type developing unit, a toner cartridge arranged in the image forming apparatus, and a method for detecting a toner level of the toner cartridge.

2. Description of the Related Art

Usually, as image print processing in an image forming apparatus using an electrophotographic system such as a laser printer or a laser copying machine, steps of charging, exposure, development, transfer, and fixing are performed in this order. In the charging step, a photosensitive drum is charged. In the exposure step, an image is drawn on the photosensitive drum charged using a laser beam. An electric charge is removed from an area on the surface of the photosensitive drum where the laser beam is irradiated. In the development step, a toner is deposited on the photosensitive drum using electric charges remaining on the surface of the photosensitive drum. In the transfer step, the toner deposited on the photosensitive drum is transferred onto a sheet. In the fixing step, the toner transferred onto the sheet is hot-melted and fixed on the sheet.

As a device that performs the development step, a revolver type developing unit is known as disclosed in JP-A-2004-264539. The revolver type developing unit is used for color printing and has a structure in which plural toner cartridges are concentrically arranged inside of a revolver. For example, when there are three toner cartridges, toners of cyan, yellow, and magenta are stored in the respective toner cartridges.

Development processing using the revolver type developing unit is performed as described below. The toner cartridge of a first color (e.g., yellow) is brought close to a photosensitive drum to deposit the toner of the first color on the photosensitive drum. The toner deposited on the photosensitive drum is transferred onto a transfer belt. Subsequently, the revolver is rotated a fixed angle such that the toner cartridge storing the toner of a second color (e.g., magenta) comes close to the rotating drum to deposit the toner of the second color on the photosensitive drum. The toner of the second color deposited on the photosensitive drum in this way is transferred onto the transfer belt. The same processing is applied to the toner of a third color (e.g., cyan). The toners of the three colors transferred onto the transfer belt in this way are transferred onto a sheet.

In the development processing, in order to maintain a satisfactory quality of a print image, it is necessary to surely supply a required amount of a toner to the photosensitive drum. Thus, the image forming apparatus includes a mechanism for detecting a toner level of a toner cartridge and, when insufficiency of the toner occurs, urging a user to replace the toner cartridge or supply the toner to the toner cartridges.

As a method of detecting a toner level of a toner cartridge, there are known a method of detecting a toner level using a capacitance sensor disclosed in JP-A-2004-354904 and a method of detecting a toner level using an optical sensor including a light emitting device and a light receiving sensor disclosed in JP-A-7-225513 and JP-A-8-123187.

In the revolver type developing unit, the toner cartridges move according to the rotation of the revolver and the toners stored in the toner cartridges also move according to the movement of the toner cartridges. Therefore, in order to measure an accurate capacitance using the capacitance sensor, it is necessary to wait for the revolver to come to a standstill and the toners settling at the bottom of the toner cartridges come to a standstill. In the method of detecting the surface of a toner staying at the bottom of a toner cartridge using an optical sensor, it is impossible to measure an accurate toner level until the toner settles at the bottom of the toner cartridge. Therefore, it is difficult to measure a toner level on a real time basis.

In the conventional toner level detecting method using an optical sensor, in order to learn a toner level stepwise, it is necessary to provide plural sensors or provide a mechanism for moving a sensor. When plural sensors are provided, product cost increases. When a mechanism for moving a sensor is provided, an apparatus structure is complicated.

SUMMARY OF THE INVENTION

The invention has been devised in view of such circumstances and it is an object of the invention to provide an image forming apparatus including a revolver type developing unit that can accurately measure a toner level on a real time basis and can be manufactured at low cost because a structure thereof is simple, a toner cartridge arranged in the image forming apparatus, and a method of detecting a toner level of the toner cartridge.

According to a first aspect of the invention, there is provided an image forming apparatus that forms an image according to an electrophotographic system, including: a cylinder that freely rotates a fixed angle at a time around a rotation shaft horizontally arranged; plural developing units that are arranged inside of the cylinder and rotate together with the cylinder and to which toner cartridges are detachable and attachable; and a toner level detecting system that has an optical sensor immovably provided outside of the cylinder. The toner level detecting system detects toner levels of the toner cartridges arranged in the developing units by rotating the cylinder a predetermined angle to stop the cylinder and measuring flow-down times of toners, which flow down inside of the toner cartridges, using the optical sensor.

According to a second aspect of the invention, there is provided a toner cartridge used in an image forming apparatus that has plural developing units arranged in a cylinder, which is arranged to freely rotate a fixed angle at a time around a rotation shaft, to rotate together with the cylinder and forms an image according to an electrophotographic system and detachable and attachable to each of the developing units in order to supply a toner to the developing unit. The toner cartridge includes: a window section of a translucent material provided in an outer wall section of the toner cartridge that faces the cylinder when the toner cartridge is arranged in the developing unit; a reflection wall that is provided inside of the toner cartridge to face the window section and the window section side of which reflects light; and a collection wall that is connected to the reflection wall and is provided inside of the toner cartridge so that one end of the collection wall is closer to the outer wall than the other end of the collection wall.

According to a third aspect of the invention, there is provided a toner cartridge used in an image forming apparatus that has plural developing units arranged in a cylinder, which is arranged to freely rotate a fixed angle at a time around a rotation shaft, to rotate together with the cylinder and forms an image according to an electrophotographic system and detachable and attachable to each of the developing units in order to supply a toner to the developing unit. The toner cartridge includes: a first wall section provided inside of the toner cartridge such that a fixed gap is formed between the first wall section and an outer wall of the toner cartridge that faces the cylinder when the toner cartridge is arranged in the developing unit; a second wall section that is connected to the first wall section and is provided inside of the toner cartridge so that one end of the second wall section is closer to the outer wall than the other end of the second wall section; and window sections of a translucent material provided in positions in end faces corresponding to the gap in a longitudinal direction of the toner cartridge, respectively.

According to a fourth aspect of the invention, there is provided a method of detecting, in an image forming apparatus that has plural developing units provided in a cylinder, which is provided to freely rotate a fixed angle at a time around a rotation shaft, to rotate together with the cylinder and forms an image according to an electrophotographic system, toner levels of toner cartridges arranged in the developing units. In the toner level detecting method, toner levels of the toner cartridges are detected by rotating the cylinder a predetermined angle to stop the cylinder and measuring flow-down times of toners, which flow down inside of the toner cartridges, using an optical sensor.

According to these aspects of the invention, it is possible to accurately detect toner levels of the toner cartridges at plural levels on a real time basis at the time of development processing with a simple and inexpensive constitution that uses one optical sensor.

DETAILED DESCRIPTION OF THE INVENTION

An embodiment of the invention will be hereinafter explained in detail with reference to the drawings. The embodiment will be explained with a color copying machine, which is a form of an image forming apparatus, as an example.

Figure 1:
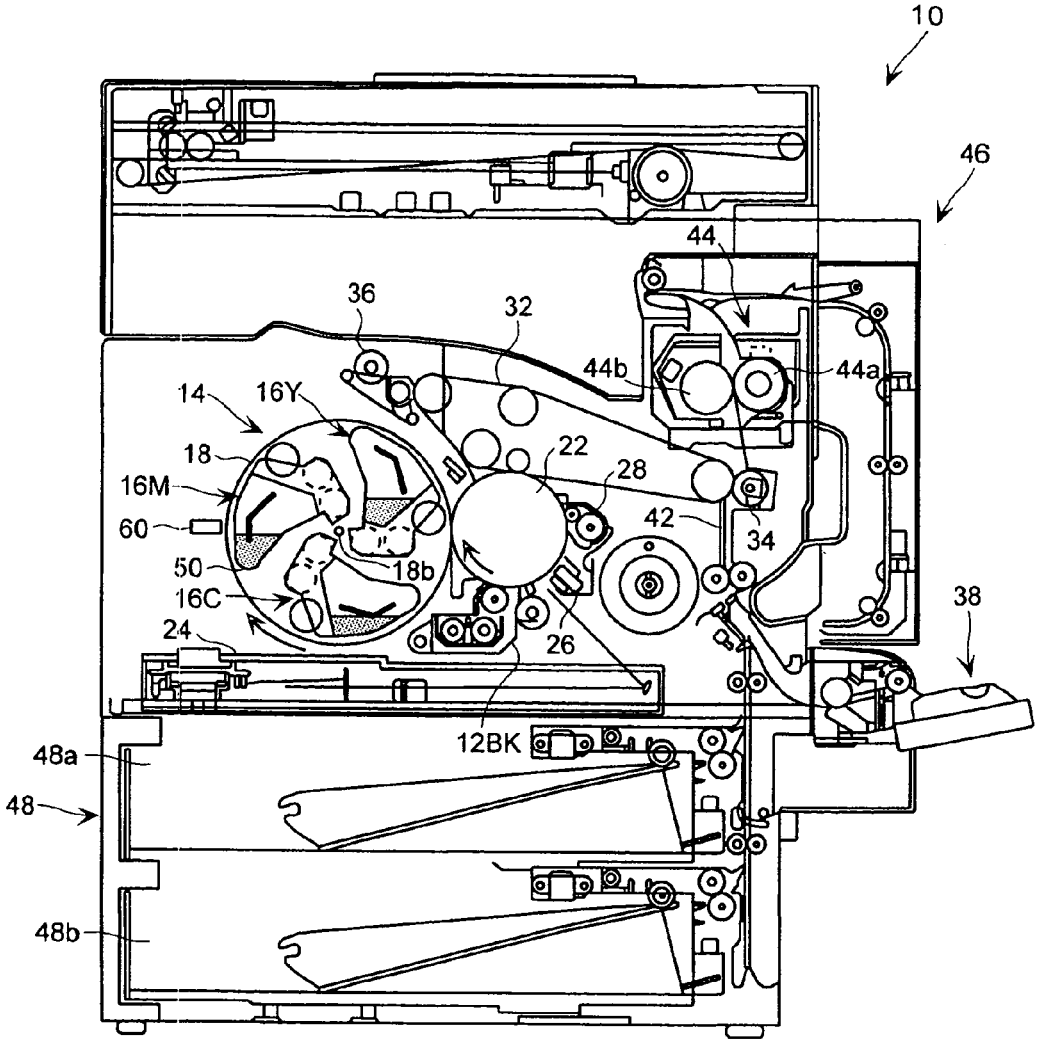
FIG. 1 is a sectional view showing an overall structure of a color copying machine.

FIG. 1 is a sectional view showing an overall structure of a color copying machine 10. The color copying machine 10 can print a color image on a sheet using toners of four colors, black (B), yellow (Y), magenta (M), and cyan (C).

The color copying machine 10 includes a fixed developing device for black 12BK, a rotational developing device 14 for yellow, magenta, and cyan, a photosensitive drum 22 for forming a latent image and a toner image, an exposing device 24 for forming a latent image on the surface of the photosensitive drum 22 by exposing the photosensitive drum 22 to light, a charging device 26 for charging the photosensitive drum 22, and a drum cleaner 28 for removing a toner remaining on the photosensitive drum 22.

The fixed developing unit 12BK comes into contact with the rotating photosensitive drum 22 and deposits a black toner on a latent image drawn on the surface of the photosensitive drum 22 by the exposing device 24 in advance.

The rotational developing device 14 includes three developing units 16Y, 16M, and 16C of yellow, magenta, and cyan and a revolver 18 that houses the developing units 16Y, 16M, and 16C. The revolver 18 freely rotates a fixed angle at a time around a rotation shaft 18*b* thereof. Each of the developing units 16Y, 16M, and 16C has a structure in which a toner cartridge 50 (hereinafter, "cartridge 50") is detachable and attachable. The rotational developing device 14 brings the developing units 16Y, 16M, and 16C into contact with the rotating photosensitive drum 22 one after another to perform development by rotating the revolver 18.

The rotational developing device 14 includes a toner level detecting system that has an optical sensor 60 for measuring a toner level of the cartridge 50 arranged in each of the developing units 16Y, 16M, and 16C. Usually, when a toner level detected by this toner level detecting system becomes low, the cartridge 50 is replaced. A detailed constitution of the toner level detecting system will be explained later.

The color copying machine 10 also includes a transfer belt 32 for transferring (primarily transferring) a toner image formed on the surface of the photosensitive drum 22, a secondary transfer roller 34 for transferring (secondarily transferring) the toner image, which is transferred onto the transfer belt 32, onto a sheet, a belt cleaner 36 for cleaning the transfer belt 32, a sheet feeding unit 48 that has sheet feeding cassettes 48*a* and 48*b* provided at upper and lower two stages, a hand supply unit 38, a vertical conveyance path 42 for conveying sheets supplied from the sheet feeding unit 48 and the hand supply unit 38 to the secondary transfer roller 34, and a fixing device 44 that has a pressure roller 44*a* and a heating roller 44*b* for holding a sheet having a toner deposited thereon to fix the toner on the sheet.

Toner images of respective colors formed on the photosensitive drum 22 change to a combined toner image on the transfer belt 32. The toner image is transferred onto a sheet from the transfer belt 32 when the sheet passes between the transfer belt 32 and the secondary transfer roller 34. The sheet having the toner image thereon further moves up through the vertical conveyance path 42. The sheet is heated when the sheet passes between the pressure roller 44*a* and the heating roller 44*b*. Consequently, the toner image is fixed on the sheet.

The color copying machine 10 further includes a duplex unit 46 for printing images on both sides of a sheet. The duplex unit 46 returns a sheet subjected to duplex printing to a lower side of the vertical conveyance path 42. The color copying machine 10 also includes a not-shown operation panel on an upper surface thereof. This operation panel has a toner indicator for displaying a toner level of the cartridge 50.

Figure 2A:
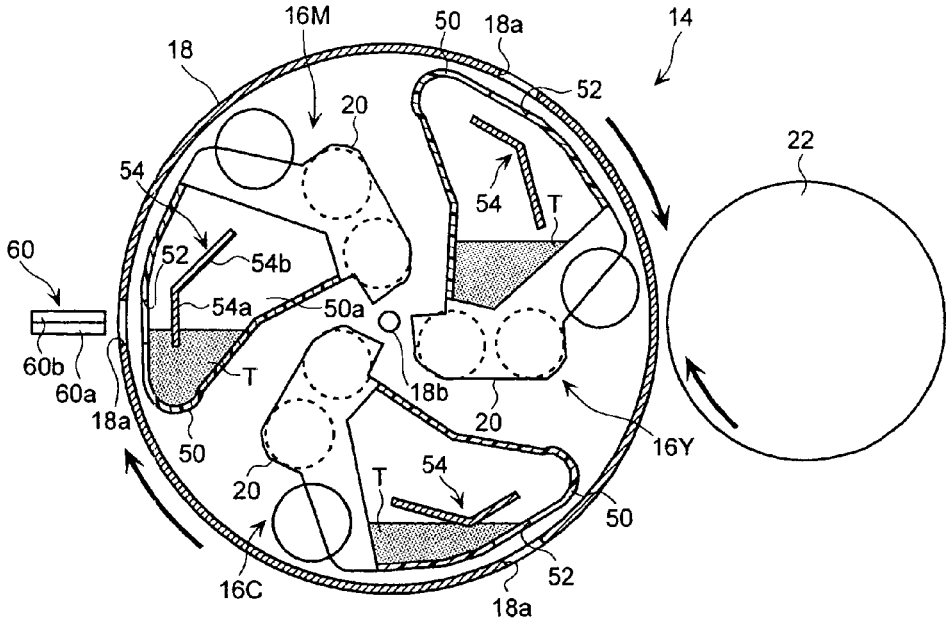
FIG. 2A is a sectional view showing a rotational developing device in FIG. 1 in an enlarged state.

The rotational developing device 14 will be explained in detail. The rotational developing device 14 is shown in FIG. 2A in an enlarged state. The developing units 16Y, 16M, and 16C have the same shape and the same structure and are arranged at equal intervals in a circumferential direction in the revolver 18. Each of the developing units 16Y, 16M, and 16C has a developing section 20 fixed to the revolver 18. The cartridge 50 is detachable and attachable to the developing section 20. The developing section 20 includes a roller or the like for transferring a toner onto the photosensitive drum 22.

In FIGS. 1 and 2A, the developing unit 16Y is at a development position. The revolver 18 rotates clockwise. When formation of a toner image by the developing unit 16Y ends, the revolver 18 rotates 120 degrees and the developing unit 16M moves to the development position. The developing unit 16M stops at the development position and forms a toner image on the photosensitive drum 22 at the development position. Thereafter, the revolver 18 further rotates 120 degrees and the developing unit 16C moves to the development position. The developing unit 16C stops at the development position and forms a toner image on the photosensitive drum 22 at the development position. After that, such an operation is repeated a necessary number of times (e.g., the number of times equivalent to the number of copies) A toner image formed on the photosensitive drum 22 is transferred onto the transfer belt 32 before the next toner image is formed thereon.

Figure 2B:
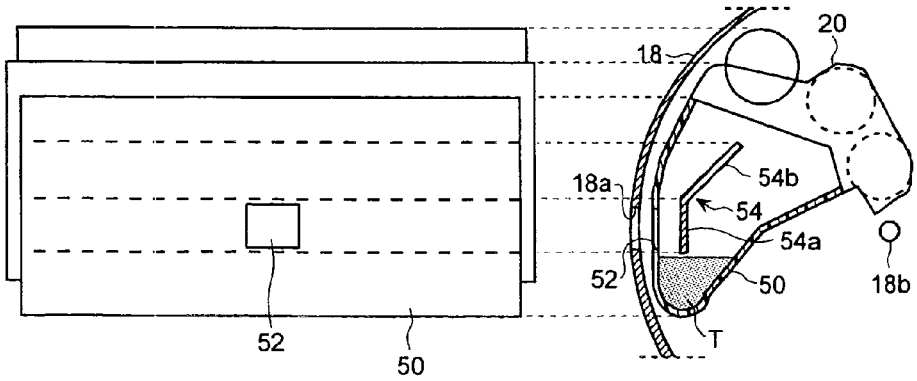
FIG. 2B is a diagram of two views showing a schematic structure of a cartridge.

A schematic front view of the cartridge 50 is shown in FIG. 2B in association with a sectional view of the cartridge 50. The inside of the cartridge 50 is formed as a toner chamber 50*a* in which a toner T is filled. A window section 52 made of a translucent material is provided in a surface that is near an internal wall surface of the revolver 18 in the cartridge 50 when the cartridge 50 is arranged in the developing section 20. The translucent member is resin or glass. The window section 52 is arranged in the center in a longitudinal direction of the cartridge 50. A wall section 54 for adjusting a flow of a toner due to the rotation of the revolver 18 is arranged in the toner chamber 50*a*. The wall section 54 is extended in the longitudinal direction of the cartridge 50. This makes movement of the toner in the cartridge 50 uniform in the longitudinal direction. The wall section 54 has a reflection wall 54*a*. A surface on the window section 52 side of the reflection wall 54*a* is formed as a metallic luster surface or a mirror surface that easily reflects light. The reflection wall 54*a* is substantially parallel to the window section 52. The wall section 54 has a collection wall 54*b* arranged so that one end of the collection wall 54*b* is closer to the outer wall of the cartridge 50 than the other end of the collection wall 54*b*.

The revolver 18 has a window 18*a* at a section opposed to the window section 52. The window 18*a* is provided in three places in total in association with the developing units 16Y, 16M, and 16C, respectively.

Figure 3A:
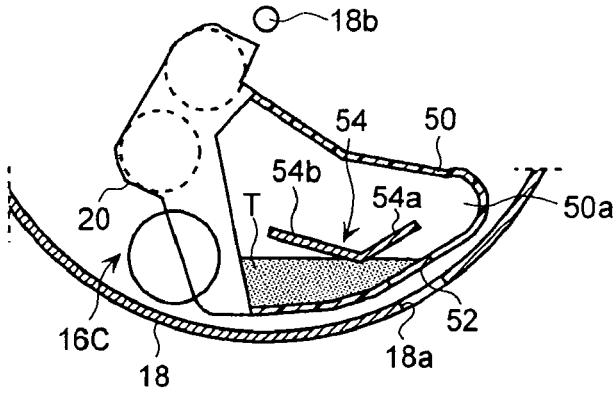
FIG. 3A is a diagram showing movement of a toner inside of the cartridge.
Figure 3B:
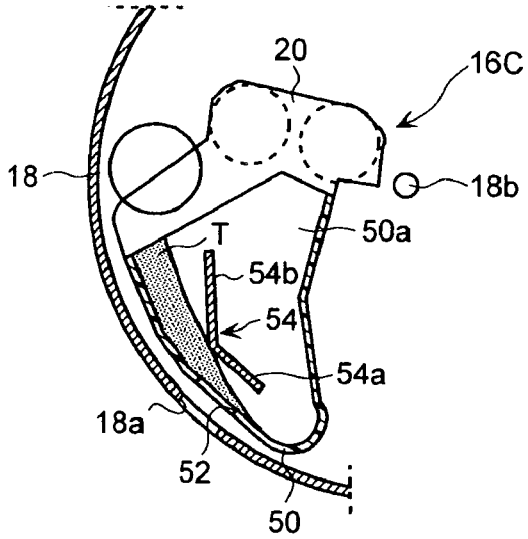
FIG. 3B is another diagram showing movement of the toner inside of the cartridge.
Figure 3C:
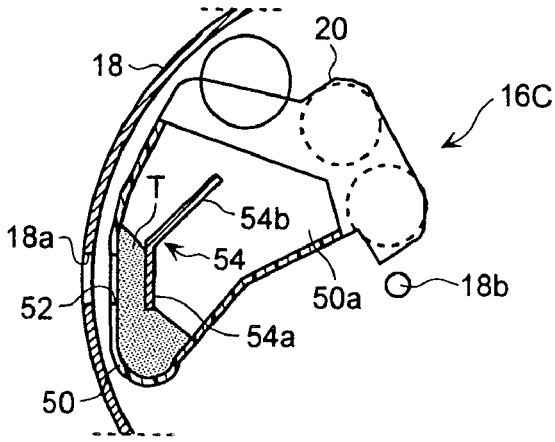
FIG. 3C is still another diagram showing movement of the toner inside of the cartridge.

FIGS. 3A, 3B, and 3C are diagrams schematically showing movement of a toner in the toner chamber 50*a* at the time when the cartridge 50 moves from the position of the developing unit 16C to the position of the developing unit 16M shown in FIG. 2A. FIG. 3A is a diagram showing a state in which the cartridge 50 is in the position of the developing unit 16C shown in FIG. 2A. In this state, the toner T settles in the lower part of the cartridge 50. When the revolver 18 is rotated 120 degrees, the cartridge 50 moves to the position of the developing unit 16M shown in FIG. 2A. When the revolver 18 is rotated in this way, as shown in FIG. 3B, the toner T gathers on the revolver 18 side of the cartridge 50 because of a centrifugal force. However, the toner T starts to slip off along the inner wall surface of the cartridge 50 because of the gravity. Since the rotation speed of the revolver 18 is high, most of the toner T falls to the lower part of the cartridge 50 after coming into a state shown in FIG. 3C. FIG. 3C is a diagram showing a state in which the cartridge 50 is in the position of the developing unit 16M shown in FIG. 2A. In this case, the toner T is gathered in a space between the window section 52 and the reflection wall 54*a* by the collection wall 54*b* and flows down through the space. The toner level detecting system measures time in which the toner T flows down the space formed between the window section 52 and the reflection wall 54*a*.

In the state shown in FIG. 2A, the optical sensor 60 faces the window section 52 of the cartridge 50 arranged in the developing unit 16M. In other words, the position of the developing unit 16M in FIG. 2A is a toner level detection position.

Figure 4A:
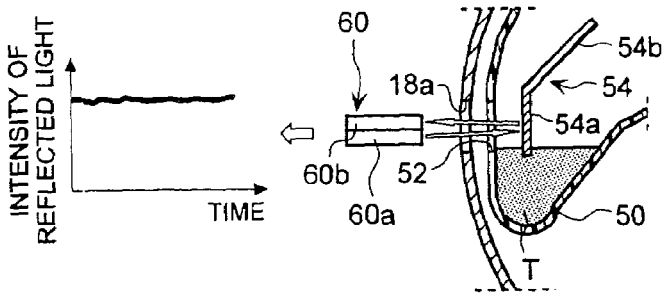
FIG. 4A is a diagram showing a toner detecting operation of an optical sensor.
Figure 4B:
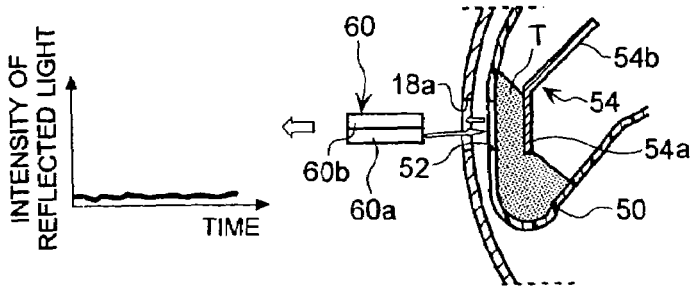
FIG. 4B is another diagram showing the toner detecting operation of the optical sensor.

A method of detecting a toner by the optical sensor 60 is schematically shown in FIGS. 4A and 4B. The optical sensor 60 includes a light emitting device 60*a* and a light receiving device 60*b*. For example, the light emitting device 60*a* is a Light Emitting Diode (LED) and the light receiving device 60*b* is a Charge Coupled Device (CCD).

The light emitting device 60*a* emits light to the window section 52 arranged in the cartridge 50. This light travels to the reflection wall 54*a* through the window 18*a* and the window section 52. As shown in FIG. 4A, when there is no toner T between the window section 52 and the reflection wall 54*a*, this light is reflected on the reflection wall 54*a*. The light receiving device 60*b* receives this reflected light. Thus, an intensity of the reflected light received by the light receiving device 60*b* is high. On the other hand, as shown in FIG. 4B, when there is the toner T between the window section 52 and the reflection wall 54*a*, the intensity of the reflected light is markedly reduced by the toner T. Thus, the intensity of the reflected light received by the light receiving device 60*b* is extremely low. Therefore, the intensity of the reflected light received by the light receiving device 60*b* has two values indicating presence and absence of a toner in the space between the window section 52 and the reflection wall 54*a*.

It is possible to detect a toner flow-down time as a count obtained by counting, at a fixed period, the intensity of the reflected light received by the light receiving device 60*b*. When the time in which the light receiving device 60*b* receives the reflected light with a low intensity is long, this means that the toner flow-down time is long. In other words, in this case, it is seen that the toner level is high. On the other hand, when the time in which the light receiving device 60*b* receives the reflected light with the low intensity is short, it is seen that the toner level is low.

When the revolver 18 rotates 120 degrees from the state shown in FIG. 2A, the developing unit 16C is arranged in the toner level detection position. The optical sensor 60 faces the window section 52 of the cartridge 50 arranged in the developing unit 16C. As explained with reference to FIGS. 3A to 3C, a toner flows down between the window section 52 and the reflection wall 54*a* inside of the cartridge 50 arranged in the developing unit 16C. The optical sensor 60 detects a flow-down time of the toner.

It is likely that the toner adheres to the window section 52. However, the window section 52 is only covered with a thin film of the toner. Therefore, even when the toner adheres to the window section 52, the light receiving device 60*b* receives reflected light with an intensity higher than that at the time when the toner flows down in the space between the window section 52 and the reflection wall 54*a*. Even if the toner adheres to the window section 52, it is possible to detect presence or absence of the toner in the space between the window section 52 and the reflection wall 54*a* by using a difference of intensities of the reflected light received by the light receiving device 60*b*. Thus, a mechanism for removing the toner adhering to the window section 52 is unnecessary in the window section 52.

Figure 5:
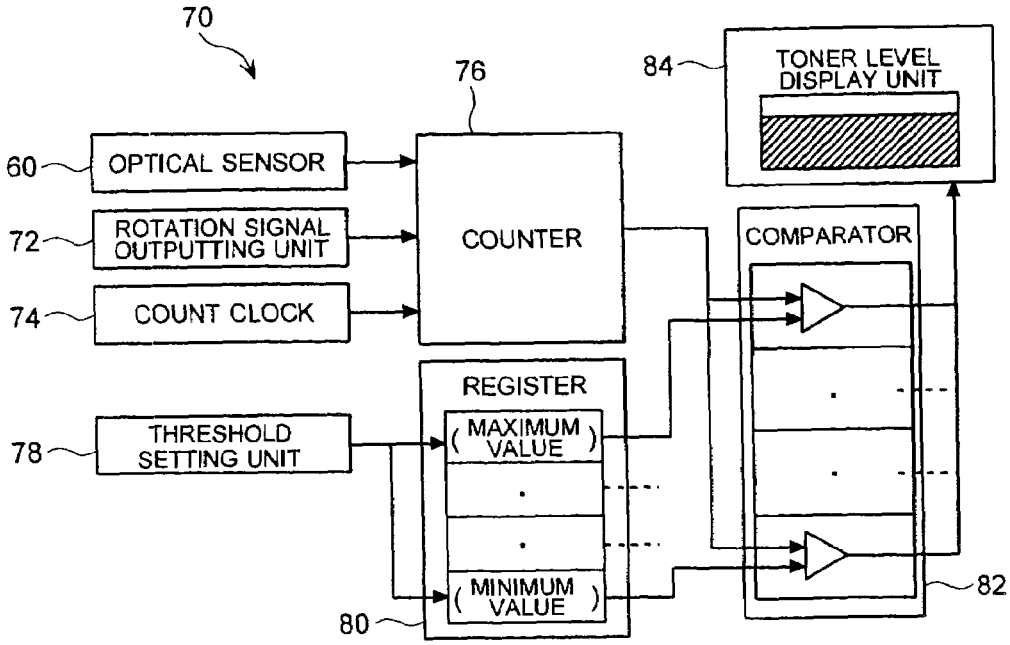
FIG. 5 is a block diagram showing a schematic constitution of a toner level detecting system.

The toner level detecting system for detecting a toner level will be explained. FIG. 5 is a block diagram showing a schematic constitution of a toner level detecting system 70. The toner level detecting system 70 includes the optical sensor 60, a rotation signal outputting unit 72 that outputs ON/OFF signals for rotation of the revolver 18, a count clock 74 for setting a sampling clock of the light receiving device 60*b* of the optical sensor 60, and a counter 76 for calculating a toner flow-down time from these signals. It is possible to set the sampling clock to, for example, a frequency of several hundred hertz to several hundred kilohertz. As the frequency is larger, it is possible to more accurately detect a toner level.

The toner level detecting system 70 further includes a threshold setting unit 78 that sets threshold values for judging levels of a toner level and a register 80 for extracting the threshold values set by the threshold setting unit 78. The threshold value setting unit 78 sets threshold values with respect to counts of intensities of reflected light received by the light receiving device 60*b*. It is possible to more accurately detect toner level by setting a large number of threshold values to subdivide the toner residual level.

The toner level detecting system 70 further includes a comparator 82 that compares a count calculated by the counter 76 and a threshold value read in the register 80 to judge a level of a toner level and a toner level display unit 84 for displaying a toner level calculated by the comparator 82. The toner level display unit 84 displays the toner level as, for example, length of a bar. When the bar is short, this indicates that a toner level is low.

Figure 6:
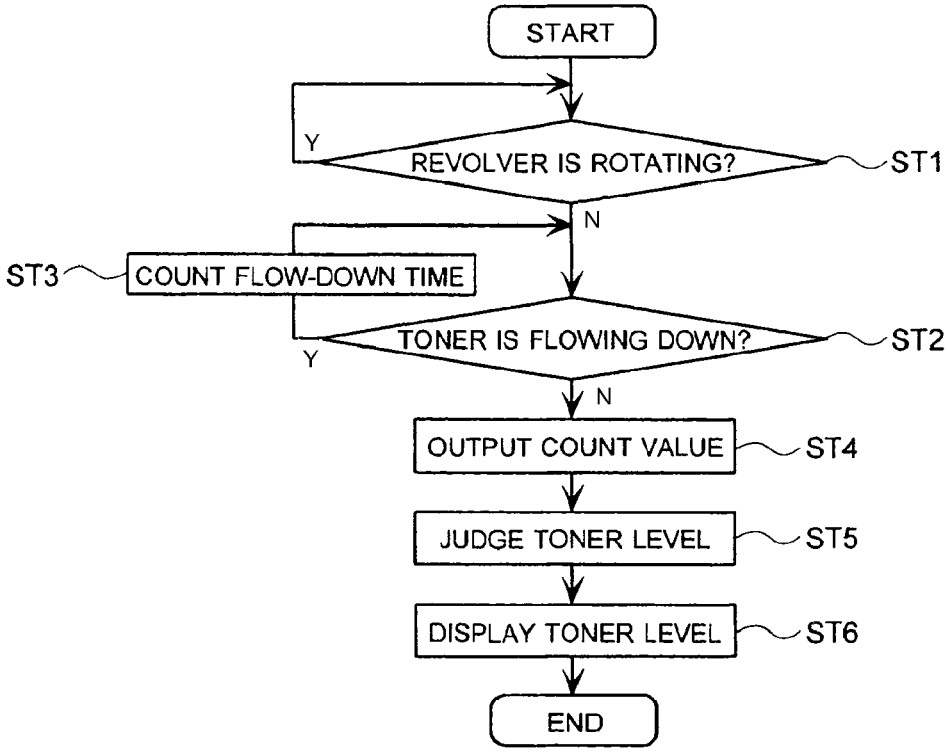
FIG. 6 is a flowchart showing a process for detecting a toner level of the cartridge.

FIG. 6 is a flowchart showing a process for detecting a toner level of one cartridge 50. A form of signal processing in the toner level detecting system 70 is specifically shown in FIG. 7.

The optical sensor 60 cannot detect a toner level when the revolver 18 is rotating. Thus, it is judged whether the revolver 18 is rotating (ST1). When the rotation of the revolver 18 stops, sampling of an intensity of reflected light received by the light receiving device 60*b* is started (ST2). The counter 76 counts a toner flow-down time (ST3).

Figure 7:
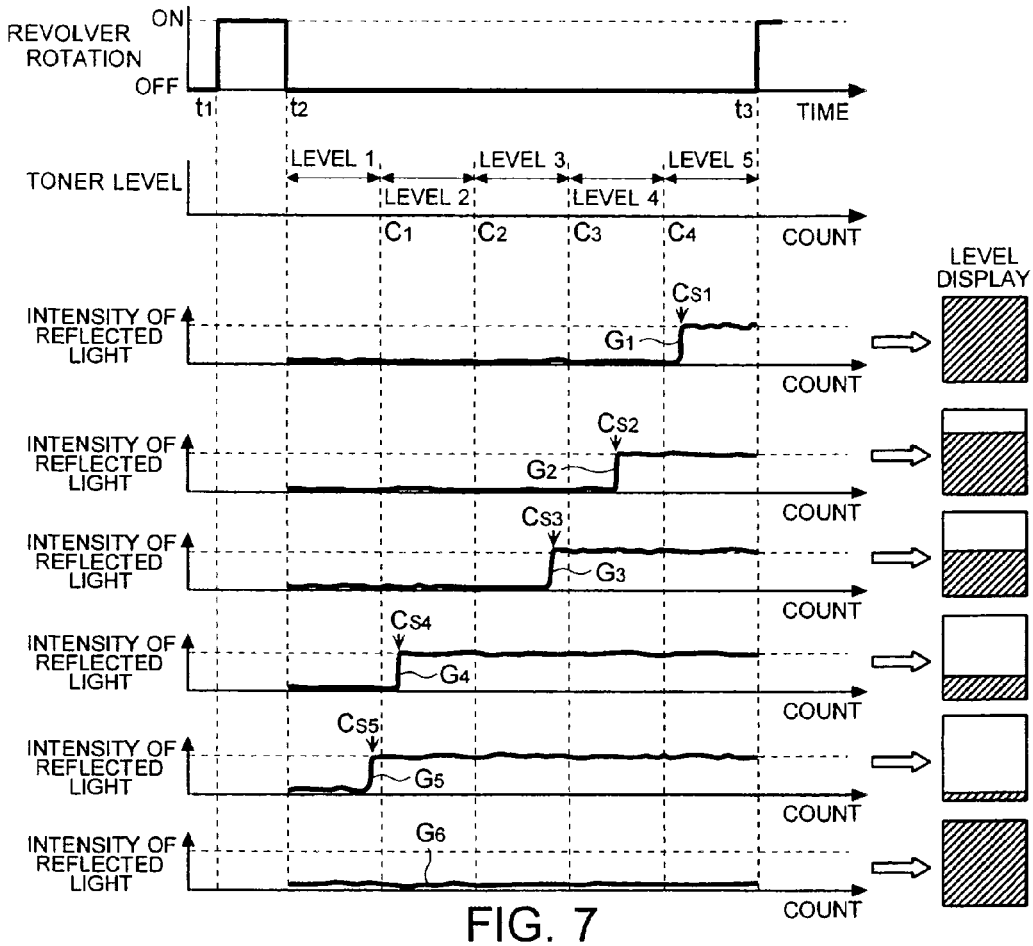
FIG. 7 is a diagram showing a form of signal processing in the toner level detecting system.

Steps ST1 to ST3 will be specifically explained with reference to FIG. 7. As shown in FIG. 7, the revolver 18 in the state shown in FIG. 2A starts rotation at time $t_1$. The rotation signal outputting unit 72 transmits an ON signal for the revolver 18 to the counter 76 at time $t_1$. The rotation of the revolver 18 ends at time $t_2$. The rotation signal outputting unit 72 transmits an OFF signal for the revolver 18 to the counter 76 at time $t_2$. The developing unit 16C comes to the toner residual detection position at time $t_2$.

A sampling clock of the light receiving device 60*b* is set in advance by the count clock 74. The threshold values set by the threshold value setting unit 78 are read into the register 80 before time $t_1$. The threshold values are set to counts $C_1$, $C_2$, $C_3$, and $C_4$. When a count is equal to or larger than 0 and smaller than $C_1$, the toner level is "toner level 1". When a count is equal to or larger than $C_1$ and smaller than $C_2$, the toner level is "toner level 2". When a count is equal to or larger than $C_2$ and smaller than $C_3$, the toner level is "toner level 3". When a count is equal to or larger than $C_3$ and smaller than $C_4$, the toner level is "toner level 4". When a count is equal to or larger than $C_4$, the toner level is "toner level 5". As described later, the toner level 1 indicates a toner empty state. The toner level 5 indicates a state in which there is enough toner.

The light emitting device 60*a* of the optical sensor 60 is always maintained in a light emitting state. The light receiving device 60*b* always receives reflected light. However, the counter 76 does not sample an intensity of reflected light received by the light receiving device 60*b* between time $t_1$ and time $t_2$.

When the counter 76 receives the OFF signal from the rotation signal outputting unit 72 at time $t_2$, the counter 76 starts sampling of an intensity of reflected light received by the light receiving device 60*b*. A count of the light receiving device 60*b* is proportional to time. In a graph $G_1$ in FIG. 6, when a count from start of sampling reaches $C_{S1}$, the intensity of reflected light increases. This change in the intensity of reflected light indicates that a toner flowing down in the space between the window section 52 and the reflection wall 54*a* runs out. Therefore, a toner flow-down time is represented by the count $C_{S1}$.

Similarly, the toner flow-down time is represented by a count $C_{S2}$ in the case of a graph $G_2$, represented by a count $C_{S3}$ in the case of a graph $G_3$, represented by a count $C_{S4}$ in the case of a graph $G_4$, and represented by a count $C_{S5}$ in the case of a graph $G_5$.

When the counting of a toner flow-down time by the counter 76 ends, a count in this counting is outputted to the comparator 82 (ST4). The comparator 82 judges under which one of the levels set by the threshold setting unit 78 this count falls (ST5). A result of the judgment is displayed stepwise as a toner level (ST6).

Steps ST4 to ST6 will be specifically explained with reference to FIG. 7. In FIG. 7, the count $C_{S1}$ (or any one of $C_{S2}$ to $C_{S5}$) is transmitted from the counter 76 to the comparator 82. The comparator 82 judges under which one of the levels set by the threshold setting unit 78 the count $C_{S1}$ falls. Since the count $C_{S1}$ falls under a range of a count equal to or larger than $C_4$, the judgment by the comparator 82 indicates the "toner level 5". This result is displayed on the toner level display unit 84.

When the count $C_{S2}$ is transmitted to the comparator 82, since the count $C_{S2}$ is equal to or larger than $C_3$ and smaller than $C_4$, the judgment by the comparator 82 indicates the "toner level 4". Similarly, since the count $C_{S3}$ is equal to or larger than $C_2$ and smaller than $C_3$, the judgment by the comparator 82 indicates the "toner level 3". Since the count $C_{S4}$ is equal to or larger than $C_1$ and smaller than $C_2$, the judgment by the comparator 82 indicates the "toner level 2". Since the count $C_{S5}$ is smaller than $C_1$, the judgment by the comparator 82 indicates the "toner level 1". Toner level is displayed as shown in FIG. 6 in response to these results. For example, when a toner level is judged as the "toner level 1", a warning of toner replacement/toner supply is displayed on the operation panel.

At time $t_2$, the developing unit 16M reaches the development position and development processing is started. When this development processing ends at time $t_3$, the rotation of the revolver 18 starts again. The rotation signal outputting unit 72 transmits an ON signal for the revolver 18 to the counter 76 at time $t_3$. At time $t_3$, the counter 76 stops sampling of an intensity of reflected light received by the light receiving device 60*b*. Thus, as indicated by a graph $G_6$ in FIG. 6, if a state in which the intensity of reflected light is small continues to time $t_3$, it is assumed that a count at time $t_3$ represents a toner flow-down time. In this case, the judgment by the comparator 82 indicates the "toner level 5".

After transmitting a count to the comparator 82, the counter 76 resets the count for the following toner level detection processing. When a count exceeds the count $C_{S4}$, the counter 76 may stop the counting of a toner flow-down time for stopping counting at that point. This is because, as a result, a toner level judged is the "toner level 5". After time $t_3$, the processing performed at time $t_1$ to time $t_3$ is repeated.

Figure 8:
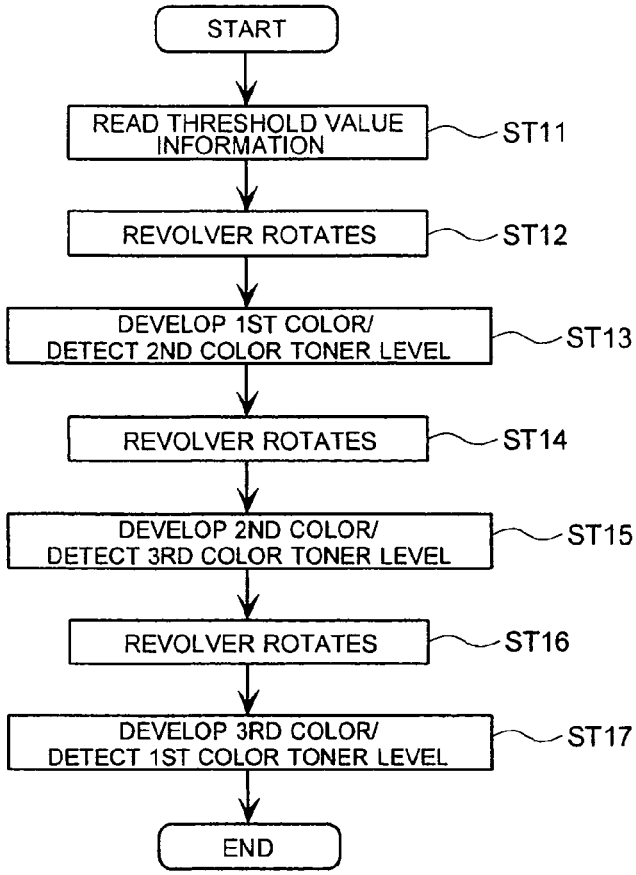
FIG. 8 is a flowchart showing a process for detecting toner levels of three developing units one after another.

FIG. 8 is a flowchart showing a process for detecting toner levels of the developing units 16Y, 16M, and 16C one after another. First, threshold value information is read out to the register 80 from the threshold setting unit 78 (ST11). In order to start development of a first color (yellow) by the rotational developing device 14, the revolver 18 rotates such that the developing unit 16Y is arranged in the development position (ST12). Consequently, the developing unit 16M for a second color (magenta) is arranged in the toner level detection position and detection and display of a toner level of the second color toner are performed as described above (ST13). Subsequently, in order to start development of the second color (magenta), the revolver 18 rotates such that the developing unit 16M is arranged in the development position (ST14). Consequently, the developing unit 16C for a third color (cyan) is arranged in the toner level detection position and a toner level of the third color toner is detected and displayed (ST15). Moreover, in order to start development of the third color (cyan), the revolver 18 rotates such that the developing unit 16C is arranged in the development position (ST16). Consequently, the developing unit 16Y for the first color (yellow) is arranged in the toner level detection position and a toner level of the third color toner is detected and displayed (ST17). As a result, the detection of the toner levels of all the color toners ends.

As described above, according to the toner level detecting system 70, it is possible to accurately detect a toner level of the cartridge at plural levels on a real time basis at the time of the development processing with a simple constitution using one optical sensor 60.

The embodiment of the invention has been explained. However, it should be understood that the invention is not limited to such an embodiment, various alterations, modifications, and replacements by those skilled in the art are possible within the scope of the invention described in claims, and the alterations, the modifications, and the replacements are also included in the scope of the invention.

For example, in the embodiment, when the cartridge 50 is in the toner level detection position, the reflection wall 54*a* is set to take a vertical posture. On the contrary, when the cartridge 50 is in the toner level detection position, the reflection wall 54*a* may be inclined so that one end of the reflection wall 54*a* is closer to the outer wall of the cartridge 50 than the other end of the reflection wall 54*a* to have a smaller distance to the outer wall of the cartridge 50 in a lower position of the reflection wall 54*a*. However, the inclination is limited to an angle that does not cause a problem in measurement of an intensity of reflected light. Further, in the embodiment, light is vertically projected on the reflection wall 54*a* from the light emitting device 60*a*. In other words, an incident angle is close to 0 degree. However, the invention is not limited to this and the incident angle may be set larger taking into account sizes of the window 18*a* and the window section 52. The light receiving device is provided in a position where light receiving sensitivity is large taking into account the incident angle.

Figure 9:
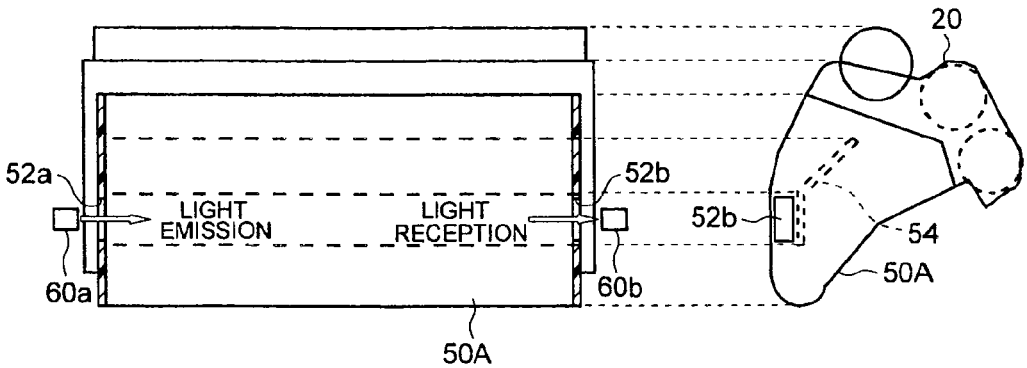
FIG. 9 is a diagram of two views showing a schematic structure of another cartridge.

It is possible to use a cartridge like a cartridge 50A shown in FIG. 9 in which window sections 52*a* and 52*b* are formed in end faces in a longitudinal direction thereof. The window sections 52*a* and 52*b* are provided at ends in a length direction of a space between the reflection wall 54*a* and an inner wall surface of the cartridge 50A. When this cartridge 50A is used, the light emitting element 60*a* and the light receiving element 60*b* are arranged outside of the ends in the longitudinal direction of the revolver 18, respectively. It is possible to replace the cartridge 50A in positions where the light emitting device 60*a* and the light receiving element 60*b* are not arranged.

Light emitted by the light emitting device 60*a* is received by the light receiving device 60*b* through the window section 52*a*, the space between the reflection wall 54*a* and the inner wall surface of the cartridge 50A, and the window section 52*b*.

While a toner flows down in this space, an intensity of transmitted light is extremely small. The intensity of transmitted light increases when the flow-down of the toner ends. This makes it possible to count a toner flow-down time and detect a toner level. When the cartridge 50A is used, the reflection surface 54*a* does not need to have a function as a reflection material. It is unnecessary to provide the window section 52 on a side of the cartridge 50A.

Figure 10:
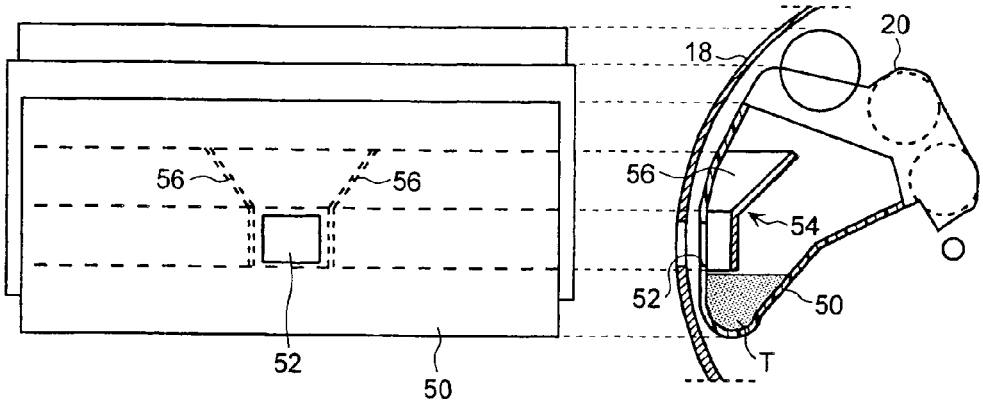
FIG. 10 is a diagram of two views showing a schematic structure of still another cartridge.

As shown in FIG. 10 similar to FIG. 2B, a partition wall 56 may be provided in the cartridge 50 such that a toner gathers near the window section 52 from the longitudinal direction of the cartridge 50.

It is also possible to apply the invention to an image forming apparatus that includes a rotary developing device including four developing units for black (B), yellow (Y) magenta (M), and cyan (C) inside of a revolver.

What is claimed is:

1. An image forming apparatus that forms an image according to an electrophotographic system, comprising:

a cylinder that freely rotates a fixed angle at a time around a rotation shaft horizontally arranged, the cylinder having a window in a side thereof;

plural developing units that are arranged inside of the cylinder and rotate together with the cylinder and to which toner cartridges are detachable and attachable, each toner cartridge comprising:

a window section of a translucent material that faces the window when the toner cartridge is arranged in each of the developing units;

a reflection wall that faces the window section and is provided inside of the toner cartridge to form a fixed gap between the window section and the refection wall and the window section side of which reflects light; and a collection wall that is connected to the reflection wall and is provided inside of the toner cartridge so that one end of the collection wall is closer to an outer wall of the toner cartridge than the other end of the collection wall; and a toner level detecting system comprising:

an optical sensor immovably provided outside of the cylinder, the optical sensor including a light emitting device that emits light to the reflection wall through the window and the window section; and a light receiving device configured to measure an intensity of reflected light from the reflection wall;

a rotation signal outputting unit configured to output ON/OFF signals for rotation of the cylinder;

a count clock configured to set a sampling clock of the light receiving device;

a counter configured to count a toner flow-down time from the intensity of reflected light received by the light receiving device after receiving the OFF signal until the ON signal;

a threshold setting unit that sets threshold values for judging toner levels;

a register configured to extract the threshold values;

a comparator that compares a count calculated by the counter and a threshold value read in the register to judge a toner level; and a toner level display unit configured to display a toner level calculated by the comparator, wherein the toner level detecting system detects toner levels of the toner cartridges arranged in the developing units by rotating the cylinder a predetermined angle to stop the cylinder and measuring flow-down times of toners, which flow down inside of the toner cartridges, using the optical sensor to detect a difference of intensities of reflected light caused by presence and absence of the toner in the gap.

2. An image forming apparatus according to claim 1, wherein a section facing the window section in the reflection wall is formed as a metal luster surface or a mirror surface.

3. An image forming apparatus according to claim 1, wherein the reflection wall and the collection wall extend in a longitudinal direction of the toner cartridge

4. An image forming apparatus according to claim 1, wherein the window is provided in a center in a longitudinal direction of the cylinder, and the window section provided in the cartridge faces the window.

5. An image forming apparatus according to claim 1, wherein the toner level detecting system rotates the cylinder a fixed angle from a state in which a toner settles between the outer wall of the toner cartridge facing the cylinder and the collection wall to thereby measure a toner flow-down time at the time when the toner flows down between the window section and the reflection wall.

6. An image forming apparatus according to claim 1, wherein the toner cartridge further includes a partition wall configured to collect the toner from a longitudinal direction of the toner cartridge between the window section and the reflection wall.

7. An image forming apparatus according to claim 1, wherein the toner cartridge includes:

a first wall section provided inside of the toner cartridge such that a fixed gap is formed between the first wall section and an outer wall of the toner cartridge that faces the cylinder when the toner cartridge is arranged in the developing unit;

a second wall section that is connected to the first wall section and is provided inside of the toner cartridge so that one end of the second wall section is closer to the outer wall than the other end of the second wall section; and window sections of a translucent material provided in positions in end faces corresponding to the gap in a longitudinal direction of the toner cartridge, respectively, the optical sensor includes a light emitting device and a light receiving device forming a pair that use the window sections and the gap as an optical path, and the toner level detecting system measures a flow-down time of the toner using a difference of intensities of transmitted light due to presence and absence of the toner in the gap.

* * * * *